United States Patent [19]

Uchida et al.

[11] 4,189,139

[45] Feb. 19, 1980

[54] NOTE COUNTING APPARATUS

[75] Inventors: Isamu Uchida; Akira Hirata, both of Tokyo, Japan

[73] Assignee: Laurel Bank Machine Co., Ltd., Japan

[21] Appl. No.: 865,420

[22] Filed: Dec. 29, 1977

[51] Int. Cl.[2] ..... B65H 1/02

[52] U.S. Cl. ..... 271/162; 271/149

[58] Field of Search ..... 271/162, 163, 164, 145, 271/4, 262, 263, 149, 150; 235/89 R; 194/1 B; 232/15, 16

[56] References Cited

U.S. PATENT DOCUMENTS

| | | | |
|---|---|---|---|
| 3,937,453 | 2/1976 | Hickey et al. | 271/263 |
| 3,961,744 | 6/1976 | Kashuba, Jr. | 232/16 |
| 4,066,253 | 1/1978 | Lundbald et al. | 271/263 |
| 4,095,781 | 6/1978 | Kistner et al. | 271/263 |

*Primary Examiner*—Robert B. Reeves
*Assistant Examiner*—Brian M. Bond
*Attorney, Agent, or Firm*—Stevens, Davis, Miller & Mosher

[57] ABSTRACT

A note counting device includes cam grooves provided on side plates thereof. A front lid is pivoted to a note storage box for opening or closing a front opening of the box and has projections adapted to engage the cam grooves upon attachment of the box to the note counting device. During movement of the note storage box along guide means of the note counting device, the front lid is first unlocked and the projections are then displaced by the cam grooves to swing the front lid about the pivot to an opened position.

1 Claim, 4 Drawing Figures

NOTE COUNTING APPARATUS

The present invention relates to a note counting apparatus comprising a note counting device and a note storage box removably attached thereto, wherein notes are delivered from the note storage box to the note counting device while being counted.

A note counting apparatus of this type is built in an automatic cash dispenser or exchanger set in a bank or the like. In most of these dispensers or exchangers, the note counting apparatus discharges the required number of notes as instructed by a customer. These machines are ordinarily installed at the counter or front of a bank or the like, and notes to be dispensed are stored in advance in a note storage box which is carried by a bank clerk to the dispenser and then placed in the note counting apparatus. During this period, the note storage box must act as a safe for preventing pilferage of notes. In order to meet this requirement, there has been developed a note storage box which is arranged so that when it is detached from the counting device, a front lid for closing a dispensing opening in the box is locked and only when the note storage box is attached to the counting device the front lid is unlocked. However, handling of the note storage box is very troublesome in case of this conventional note storage box since after the note storage box has been attached to the counting device, it is necessary to manually operate the front lid in order to open the dispensing opening.

Accordingly, it is a primary object of the present invention to provide a note counting apparatus in which the above-mentioned front lid of a note storage box is automatically unlocked or locked, and simultaneously opened or closed, in response to attachment of the note storage box to a note counting device or withdrawal of the note storage box therefrom, whereby handling of the note storage box can be remarkably facilitated and pilferage of notes prevented.

One embodiment of the note counting apparatus of the present invention will now be described with reference to the accompanying drawings.

Figure 1:
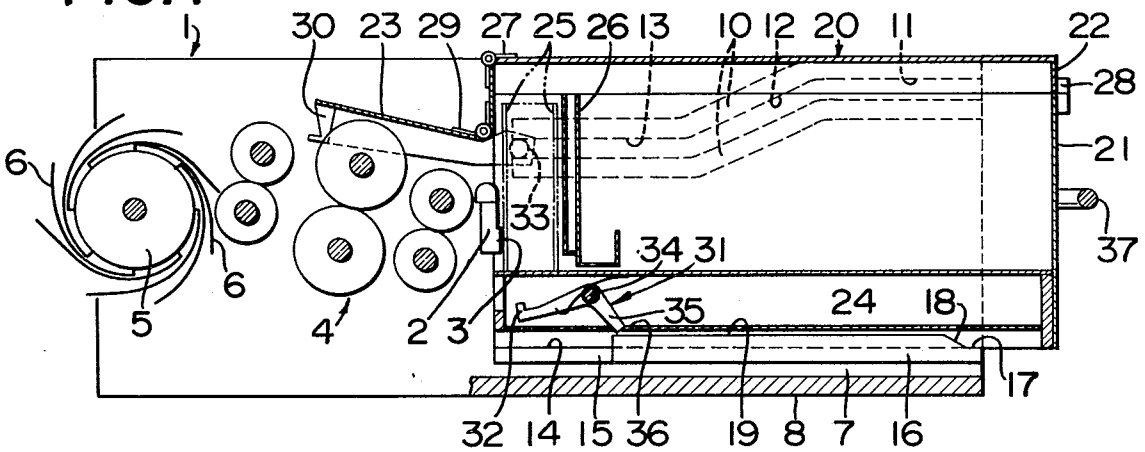
FIG. 1 is a longitudinal sectional side view showing diagrammatically the entire structure.

In the drawing, reference numeral 1 represents a paper counting device having a known mechanism. More specifically, the paper counting device is equipped with a suction head 2 having a suction opening 3 to which notes stored in a note storage box described hereinbelow are attracted one by one. After this sucking operation, the suction head 2 is turned in the clockwise direction in FIG. 1 to feed the attracted note into a feed roller mechanism 4. The note is delivered through the roller mechanism 4 to blades 6 of an accumulating wheel 5 while the notes are counted by a counter (not shown). Rotation of the accumulating wheel 5 in the counterclockwise direction in FIG. 1 allows a known scrape-down plate (not shown) to drop the notes, delivered to the blades 6, on an appropriate delivery member located below.

In the rear portion of the note counting device 1, there is formed a chamber 9 for receiving a note storage box 20 consisting of a space defined by both the side plates 7 and bottom plate 8. A pair of vertically spaced guide members 10 are attached to the top portion of the inner surface of each of the side plates 7. As shown in FIG. 1, the guide members 10 define a guide groove having a first horizontal portion 11, a downwardly inclined portion 12 connected to the left end of the first horizontal portion 11 and a second horizontal portion 13 connected to the left end of the inclined portion 12. Guide members 15 are attached to the lower opposite portions of the inner surfaces of the side plates 7 and include cam plates 16 attached thereto and guide grooves 14. As shown in FIG. 1, each cam plate 16 has a cam surface consisting of a first horizontal portion 17, an upwardly inclined portion 18 and a second horizontal portion 19 extending from the inclined portion 18. The inclined portion 18 of each of the cam plates 16 is positioned at the middle of the first horizontal portions 11 of the above-mentioned guide members 10.

Figure 2:
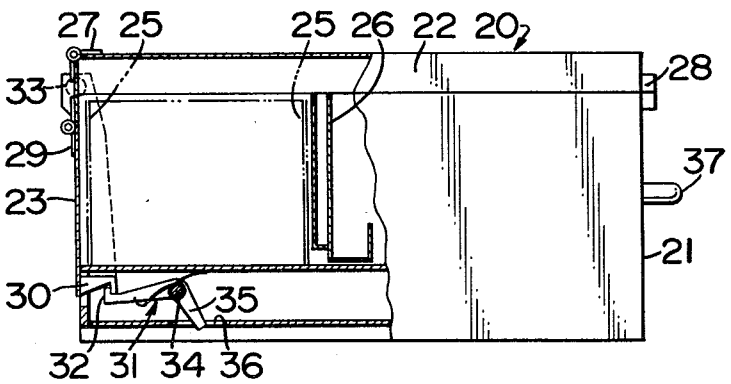
FIG. 2 is a partially broken away side elevational view of the note storage box.
Figure 3:
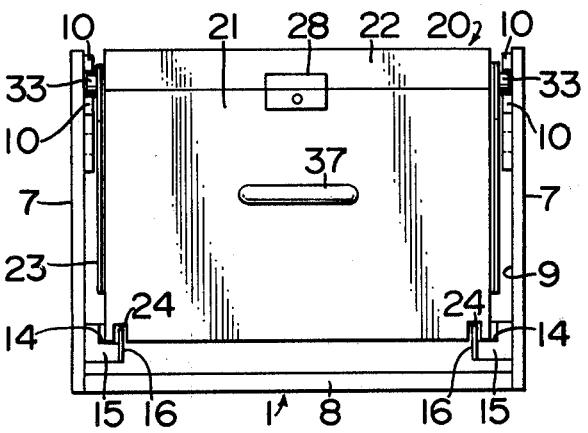
FIG. 3 is an end view of the note storage box.
Figure 4:
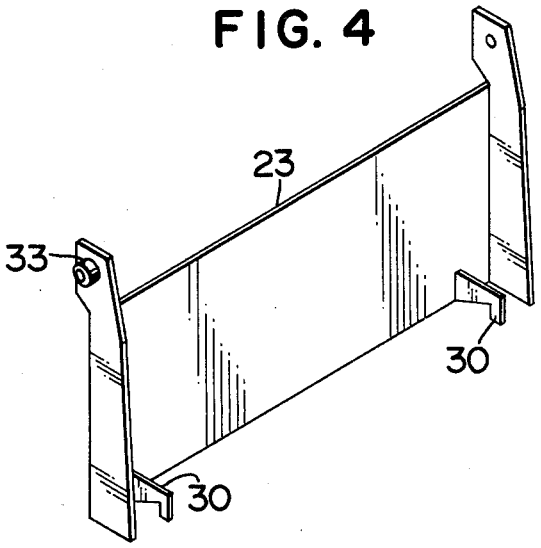
FIG. 4 is a perspective view showing the front lid.

The note storage box 20 comprises a casing 21 having an upper opening and an upper cover 22 for opening or closing the opening of the casing 21, and a front lid 23 for opening or closing a front opening formed in the front wall of the casing 21. Grooves 24 are formed on the bottom of the casing 21 to engage the cam plates 16. A movable pressing plate 26 is disposed in the interior of the casing 21 to press notes 25 stored on an inner plate in the casing 21 toward the opening in the front wall of the casing 21. The upper cover 22 is pivotably attached to the upper end of the front wall of the casing 21 by means of a hinge 27, and is locked in the closed state by a key 28. The front lid 23 is pivotably attached to the front wall of the casing 21 adjacent the upper edge of the front opening by means of a hinge 29. A pair of hooks 30 are attached to the lower end of the front lid 23 on its inner surface and extend through the front wall of the casing when the front lid 23 is in its closed position. A pair of latch members 31 in the form of bell cranks are pivoted to a transverse shaft 34 disposed in the casing 21 and urged in the clockwise direction by means of a spring as shown in FIGS. 1 and 2. One of arms of each latch members 31 has a latch portion 32 for engaging each hook 30 and the other arm is an operating portion 35 extending downwardly through a through-hole 36 formed in the bottom of the casing 21 into the groove 24 and engaging the cam face of the corresponding cam plate 16. Rollers 33 are mounted on side plates of the front lid 23 to engage in the guide grooves of the guide members 10 are attached to the upper portions of both the side faces of the front lid 23, respectively. In the drawing, reference numeral 37 represents a handle.

In operation, the key 28 is first released to open the upper cover 22. Next, the movable pressing plate 26 is moved to the right in FIG. 1 and in this state, the notes 25 are put in the note storage box 20. The upper cover 22 is then closed and locked by the key 28. In this state, the front lid 23 has closed the opening in the front wall of the casing 21, and as can be seen in FIG. 2, the latch portions 32 of the latch members 31 is in engagement with the hooks 30. Accordingly, the note storage box 20 now acts as a portable safe.

When the note storage box 20 is inserted into the receiving chamber 9 of the counting device 1 from right to the left in FIG. 1, the casing 21 is supported on and moved along the guide groove 14 of the guide member 15. At the same time, the rollers 33 on the front lid 23 is engaged by the first horizontal portions 11 of the guide grooves of the guide members 10. When the note storage box 20 is being moved to the left in FIG. 1 in this state, the operating portions 35 of the latch members 31 contact the inclined portion 18 of the cam plate 16 and then the second horizontal portion 19 of the cam plate 16, whereby the latch members 31 are pivotably moved in the counterclockwise direction in FIG. 1 against the force of the spring and the engagement of the hooks 30 with the latch portions 32 is released. Next, the rollers 33 engage the inclined portions 12 of the guide grooves of the guide members 10 so that the front lid 23 will be swung about the hinge 29 in the clockwise direction in FIG. 1 to open the opening in the front wall of the casing 21. With further movement of the note storage box 20, the rollers 33 are allowed to engage with the second horizontal portions 13 of the guide members 10, and the front lid 23 is moved to substantially horizontal position. Thus, the note storage box 20 is accommodated in the chamber 9 of the note counting device 1 as indicated by the solid line in FIG. 1.

When the note storage box 20 is withdrawn from the note counting device 1, the movement of the note storage box 20 to the right in FIG. 1 allows the rollers 33 to engage with the inclined portions 12 of the guide members 10, whereby the front lid 23 is swung back in the counterclockwise direction in FIG. 1 to the initial position closing the opening of the front wall of the casing 21. When the operating portions 35 of the latch members 31 have moved from the second horizontal portions 19 to the inclined portions 18 of the cam plates 16, the inclined portions 18 allow the latch members 31 to turn in the clockwise direction in FIG. 1 by the force of the spring so that the latch portions 32 will engage the hooks 30 to lock the front lid 23 to the box 20. Thus, the note storage box 20 can be withdrawn from the note counting device 1 in the locked state where the front lid 23 is closed.

As will be apparent from the foregoing illustration, in the note counting apparatus of the present invention, the operation of attaching the note storage box to the note counting device or detaching the note storage box therefrom unlocks or locks the front lid of the note storage box automatically. Accordingly, before the note storage box is attached to the counting device, the front lid cannot easily be opened and pilferage of notes can be prevented. Moreover, the front lid can be opened or closed without performing any particular operation, and note storage box can be handled very easily.

What is claimed is:

1. In a note counting apparatus having a counting device and a note storage box removably attached to the counting device wherein a front lid of the note storage box is unlocked in response to movement of the note storage box to a predetermined position along guide means of the counting device, the improvement comprising cam grooves on side plates of the counting device, means pivoting the front lid to said note storage box for opening or closing a front opening of the box, projections for engaging the cam grooves upon attachment of the note storage box to the note counting device, so that during the movement of the note storage box along the guide means, the front lid is first unlocked and said projections are then displaced by the cam grooves to swing the front lid about the pivot means to an opened position.

* * * * *